US005246069A

United States Patent [19]

Glaser et al.

[11] Patent Number: 5,246,069

[45] Date of Patent: Sep. 21, 1993

[54] SELF-ALIGNING WELL APPARATUSES AND ANTI-ROTATION DEVICE FOR WELL APPARATUSES

[75] Inventors: Mark C. Glaser, Houston; Gary L. Thompson, Katy, both of Tex.

[73] Assignee: Weatherford-Petco, Inc., Houston, Tex.

[21] Appl. No.: 856,098

[22] Filed: Mar. 23, 1992

Related U.S. Application Data

[63] Continuation-in-part of Ser. No. 700,622, May 15, 1991, Pat. No. 5,113,940, which is a continuation of Ser. No. 517,925, May 2, 1990, Pat. No. 5,025,858.

[51] Int. Cl.[5] ..... E21B 33/16

[52] U.S. Cl. ..... 166/156; 166/153; 166/155; 166/192; 166/242

[58] Field of Search ..... 166/153, 156, 242, 291, 166/192, 155

[56] References Cited

U.S. PATENT DOCUMENTS

| | | | |
|---|---|---|---|
| 3,006,415 | 10/1961 | Burns et al. | 166/156 |
| 3,550,683 | 12/1970 | Comeaux | 166/156 |
| 3,842,905 | 10/1974 | Morrisett et al. | 166/155 |
| 4,175,619 | 11/1979 | Davis | 166/153 X |
| 4,190,111 | 2/1980 | Davis | 166/291 |
| 4,190,112 | 2/1980 | Davis | 166/291 |
| 4,706,747 | 11/1987 | Schneider | 166/153 |
| 4,711,300 | 12/1987 | Wardlaw, III et al. | 166/153 |
| 4,836,279 | 6/1989 | Freeman | 166/153 |
| 4,858,687 | 8/1989 | Watson et al. | 166/153 |
| 4,979,562 | 12/1990 | Langer | 166/242 |
| 5,025,858 | 6/1991 | Glaser | 166/156 |
| 5,095,980 | 3/1992 | Watson | 166/192 |
| 5,113,940 | 5/1992 | Glaser | 166/156 |

OTHER PUBLICATIONS

"Positive Seal/Positive Drill Float & Plug System," McAllister Petroleum Services, 1987.

Oil Well Cementing Practices in The United States, American Petroleum Institute, p. 112, 1959.

Halliburton Services Sales and Service Catalog, vol. 4, 1986-87 Composite Catalog pp. 2440-2451.

Chapter 10, Primary Placement Techniques.

Weatherford General Services and Products Catalog 1988-1989 1987, pp. 4132-4139.

*Primary Examiner*—Hoang C. Dang

*Attorney, Agent, or Firm*—Guy McClung

[57] ABSTRACT

Well apparatuses with device for preventing their relative rotation with respect to adjacent well apparatuses and anti-rotation devices for well apparatuses, including, but not limited to, plugs, float shoes, float collars, jars, and clutch devices for packers. In one embodiment self-aligning non-rotation devices are provided with body members having protrusions extending from recesses therein, the protrusions and recesses configured and disposed so that two opposed devices which initially misalign will co-act to align themselves. In another embodiment an intentional "sloppy fit" is provided between two opposed devices to facilitate device contact and co-action. In various embodiments unwanted separation of two devices is prevented due to the configuration of protrusions. In one embodiment a non-rotation device has a main member with a recess on which are disposed a plurality of teeth with a load member adjacent the teeth for bearing a load put on the device and for isolating the teeth from the load, the teeth extending beyond the recess. In one embodiment the teeth are configured, disposed, and profiled to facilitate their interengagement with other teeth and to contain between them foreign objects which might impede proper interengagement. In various embodiments plugs or other equipment are provided with such anti-rotating devices. In various embodiments the load member is a continuous circular ring disposed about the apparatuses outer periphery or around the opening of a channel through the device. The load members may be non-continuous upstanding members.

13 Claims, 10 Drawing Sheets

SELF-ALIGNING WELL APPARATUSES AND ANTI-ROTATION DEVICE FOR WELL APPARATUSES

Cross Reference To Related Application

This is a continuation-in-part of U.S. application Ser. No. 700,622 filed on May 15, 1991 now U.S. Pat. No. 5,113,940 which is a continuation of U.S. application Ser No. 07/517,925 issued on May 2, 1990 now U.S. Pat. No. 5,025,858 issued on Jun. 25, 1991.

BACKGROUND OF THE INVENTION

Field of the Invention

This invention relates to well apparatuses and to anti-rotation devices for well apparatuses used in well operations, such as plugs, jars, float collars, float shoes, cementing stage tools, liner hangers, and clutch devices for packers; and in one embodiment to non-rotating plugs for well cementing operations.

Description of Related Art

Once a wellbore has been drilled, operations within the wellbore are facilitated by placing a string of tubular casing in the wellbore so that operations can be conducted in and through the casing rather than in an uncased wellbore.

For a variety of reasons, cement is introduced into the annular space between the interior wall of the wellbore and the exterior surface of the casing: to form a protective barrier around the casing; to isolate multiple producing formations through which the wellbore extends; and to displace unwanted fluids or material in the annular space between the wellbore and the casing.

After a cased wellbore has been perforated so that production at a particular depth and from a particular formation is achieved, secondary cementing is often employed to force cement into the perforations to seal off the formation, wellbore, and casing. When it is desired to reduce the depth of a wellbore or to place cement at particular points in a wellbore, a technique called "plug back cementing" is employed.

Usually cement is introduced into the annular space between a wellbore and a string of casing by pumping the cement down through the casing, out through the opening at the end of the casing, and back up into the annular space. To prevent the cement from flowing back up into the casing, float shoes and float collars are used at or near the end of the casing. Float collars usually comprise restrictions or shoulders of cement within a tubular member which can be interposed between two casing joints a few joints above a float shoe at the end of the casing string. Either or both of the collar and shoe usually have a check valve which prevents the back flow of cement from the annular space back up into the casing.

A variety of plugs are typically used in cementing operations. These plugs are moved down into the casing by pumping cement or a fluid into the casing on top of the plugs. These plugs accomplish a variety of functions. They provide a divider of separation barrier between the cement on top of the plug and any fluid beneath the plug or between cement beneath the plug and a fluid on top of the plug. Plugs with wipers wipe off the interior surface of the casing as they pass through it. Plugs of sufficient bulk assist in preventing the back flow of cement beneath the plugs.

In a typical cementing operation a collar or shoe, or both, are placed on a casing string and casing is run into the wellbore to a desired level. A bottom pump down plug is then inserted into the casing and wet cement is pumped on top of the plug. The plug moves down the casing, pushing in front of it any fluid, such as drilling fluid or water, which may be present in the casing. The plug moves down until is encounters the float collar. Increased pumping pressure and the weight of the cement above the plug break a diaphragm disposed across a channel that extends through the plug. This permits the cement to flow through the float collar, the weight of the cement forcing open any check valves in the collar or shoe. The cement then flows out from the bottom of the casing, into the wellbore, and up into the annular space between the wellbore and the casing.

To raise the cement to a desired level in the annular space, a top pump down plug is inserted into the casing. Fluid is pumped onto the top pump down plug moving it into contact with the cement. Further fluid pumping pushes the top pump down plug and the cement down into the casing, forcing cement out of the bottom of the casing and further up in the annular space until a desired level of cement is reached. The top plug can be pumped down to contact the bottom plug. The cement then sets and various operations are carried out in the wellbore.

When the well operations have been completed, the plugs, collar and shoe may be drilled out. All of these items are made from drillable material such as plastic, rubber, wood, or drillable metal. The cement in the float collar is also drillable.

Often a rotating drill bit will contact a plug and cause the plug to rotate and then slip on the surface with which it is contact, e.g. the top of a bottom plug or a layer of cement. This slipping is inefficient and wastes time and energy. A variety of prior art devices have addressed this problem. The attempted solutions typically involve the use of some sort of protrusions, projections or teeth on plug ends to prevent rotation or the use of a plate with teeth on both sides that is placed between a plug and a surface over which a plug could potentially slip.

A variety of problems have been encountered with these prior art efforts. Often the teeth on the various devices contact each other and it is then the teeth alone that are forced to bear whatever load is imposed on the plug or plate. These loads can be enormous, crushing or distorting the teeth so that they do not function properly. Other prior art plugs have teeth which are configured and disposed so that the leading edges of the teeth meet and cross, not permitting further engagement of the lateral portions of the teeth. In other plugs the profile, number, and spacing of the teeth is such that any object or debris between the plugs prevents interengagement of the teeth on two adjacent plugs; i.e., the plugs are prevented from accomplishing the desired non-rotating function. With prior art devices in which the teeth are relatively short, slight separation caused for example by a bouncing drill bit off of two tools, e.g. plugs, with such teeth can cause disengagement, relative spinning movement, or ratcheting between the teeth, i.e., the non-rotation function is not accomplished. Previously used protrusions for piercing or gripping rubber may not have sufficient gripping engagement to prevent rotation.

There has long been a need for an effective and efficient structure for preventing the relative rotation of well plugs and other devices and tools during well operations, including, but not limited to, the drill out of plugs and cement. There has long been a need for a structure that keeps teeth or protrusions from preventing the relative rotation of devices. There has long been a need for a structure that prevents teeth or protrusions from bearing large loads which can injure the teeth or protrusions. There has long been a need for a structure which prevents debris or foreign objects from inhibiting the interengagement of such teeth or protrusions. There has long been need for an easily drillable plug.

In accordance with 37 C.F.R. §1.56, the following are disclosed:

U.S. Pat. No. 4,190,111 discloses a plate with tooth-like protrusions on each side which can be placed between objects in a well such as a plug and a float shoe or collar to prevent their relative rotation.

U.S. Pat. No. 4,836,279 discloses a plug which has downwardly facing elongated projections (rather than teeth and relatively much longer than teeth) and another plug with a plurality of longitudinal recesses (rather than teeth) corresponding to the elongated projections for preventing the relative rotation of the plugs.

"Halliburton's Non Rotating Cementing Plugs," Halliburton Services Sales Technical Data discloses cementing plugs with locking teeth (rather than elongated projections and corresponding recesses) on both the top and bottom plug and on a float collar for preventing plug rotation during drill out.

U.S. Pat. No. 4,711,300 discloses cementing plugs and collars with locking interfaces for preventing relative rotation.

U.S. Pat. No. 3,550,683 discloses a float shoe with slots for receiving a plug with corresponding protuberances on the plug to prevent plug rotation during drill out.

The following are of general interest and provide general information related to plugs and well cementing operations: U.S. Pat. Nos. 3,842,905; 3,006,415; and 4,706,747; Oil Well Cementing Practices in The United States, American Petroleum Institute, page 112, 1959; Halliburton Services Sales and Service Catalog, Volume 4, 1986–87 Composite Catalog pages 2440–2451; Chapter 10, Primary Placement Techniques; Weatherford General Services and Products Catalog 1988–89, 1987, pages 4132–4139.

SUMMARY OF THE INVENTION

The present invention is directed to a structure which prevents the relative rotation of devices used in wellbore operations, such as plugs, float collars, float shoes, jars, and clutch devices for packers.

In one embodiment of the present invention an apparatus is provided which has a generally cylindrical body member with an inner recess in which a plurality of teeth or protrusions are disposed and from which a portion of the teeth or protrusions extend. A portion of the body member, such as a continuous or discontinuous inner or outer portion of the body member, is configured and disposed as a load member so that when two such apparatuses are moved together the load member portions of their body members come into contact thereby transferring a load on the apparatuses through this load member rather than on the protrusions. The teeth or protrusions are configured and disposed so that they extend sufficiently to interengage with the teeth or protrusions on an adjacent member; but they do not extend to such a length that they prevent the load members of two adjacent apparatuses from contacting to take a load off of the teeth or protrusions. In certain preferred embodiments these load members are continuous rings disposed either around the body member's outer periphery or around a channel opening central to the body. However, these load members need not be rings and they need not be continuous. Such an apparatus can be conveniently placed in, formed of, disposed in or on, or threadedly connected to a variety of devices such as plugs, float collars, and stage cementing tools to prevent the relative rotation of the devices and to prevent large loads from crushing or otherwise damaging the teeth or protrusions.

In one embodiment the teeth or protrusions are configured, profiled, and disposed so that their cross-section is constant from the outer edge of the apparatus to a more central point thus providing a tooth or protrusion with strength along its entire length and for easy interengagement with the teeth or protrusions of another similar device. In one embodiment the teeth or protrusions are profiled, configured, and disposed so that space is provided between them for foreign objects or debris which might otherwise prevent or impede proper interengagement of the teeth or protrusions. In one embodiment the outer edges of the teeth or protrusions are bevelled inwardly to facilitate interengagement between apparatuses. In one embodiment a plug is provided with all of these features. In one embodiment a float collar is provided with some or all of these features. In one embodiment a frangible diaphragm is disposed in a groove in the apparatus which, when broken, permits fluid flow through a longitudinal channel through the apparatus. In one embodiment a bottom pump down plug with all of these features is provided. Protrusions or projections (one or more) may be provided on the device for protruding into a material like cement or plastic in which the device is disposed or embedded to prevent movement or rotation of the device with respect to the material. Recesses, scoops, pockets, indentations or grooves (one or more) can provide a similar function when disposed so that a portion of the material is set within the recess, etc. to prevent relative movement.

In another embodiment of this invention an anti-rotation device is provided for an item used in wellbores for inhibiting relative rotation between the item and an adjacent apparatus having apparatus protrusions, the anti-rotation device having a substantially cylindrical body with two ends and a rim extending around one of the ends, and a plurality of device protrusions extending from the body member and beyond the rim, the device protrusions disposed for contacting the apparatus protrusions of the adjacent apparatus, the device protrusions offset from the rim inwardly toward a center of the body member to facilitate contact of and co-action with the item used in wellbores and the adjacent apparatus.

In another embodiment of this invention an anti-rotation device is provide for an item used in wellbores for inhibiting relative rotation between the item and an adjacent apparatus having apparatus protrusions, the anti-rotation device having a substantially cylindrical body member having two ends, an inner wall, and a rim extending around one of the ends, and a plurality of device protrusions extending from the body member and beyond the rim, each device protrusion preferably having a rounded top, the device protrusions disposed for contacting the apparatus protrusions of the adjacent apparatus, the device protrusions offset from the rim inwardly toward a center of the body member to facilitate contacting of and co-action with the item used in wellbores and the adjacent apparatus, an upwardly extending portion of each device protrusion having two planar faces to facilitate contact of the item used in wellbores and the adjacent apparatus and to reduce point and line contact between the device protrusions and the adjacent apparatus, the rounded top portion of each device protrusion wider at an outer edge of the body member than at an inner part thereof, and a recess in the body member, the recess defined by the inner wall and a bottom surface within the body member, the device protrusions extending from the bottom surface of the recess and disposed for contacting and co-acting with the apparatus protrusions of the adjacent apparatus, the inner wall sloping to the bottom surface of the recess.

Another embodiment of this invention provides an anti-rotation plug for use in a wellbore, the plug having a plug body with a top and a bottom, an anti-rotation device secured to the plug body for inhibiting relative rotation between the plug and an adjacent apparatus having apparatus protrusions, the anti-rotation device having a substantially cylindrical body member having two ends and a rim extending around one of the ends, and a plurality of device protrusions extending from the body member and beyond the rim, the device protrusions disposed for contacting the apparatus protrusions of the adjacent apparatus, the device protrusions offset from the rim inwardly toward a center of the body member to facilitate contacting of and co-action with the apparatus protrusions.

Another embodiment of this invention provides an anti-rotation device for an item used in wellbores for inhibiting relative rotation between the item and an adjacent apparatus having apparatus protrusions, the anti-rotation device having a substantially cylindrical body member having two ends and a rim extending around one of the ends, and a plurality of device protrusions extending from the body member and beyond the rim, the device protrusions disposed for contacting the apparatus protrusions of the adjacent apparatus, the device protrusions and the apparatus protrusions each having at least two faces, the faces of the protrusions configured and disposed so that upon contact of the apparatus protrusions and device protrusions each device protrusion contacts one corresponding apparatus protrusion and upon co-action of said device protrusions with said apparatus protrusions only one face of each said device protrusion co-acts with only one face of each said apparatus protrusion while inhibiting relative rotation between the item and the adjacent apparatus.

In certain preferred embodiment of this invention the device has a circumference and protrusions are spaced apart from each other about the circumference, each device protrusions having a base at the floor of the recess, the bases occupying between about 30% to about 70% of the device's circumference with spaces between the protrusions, apparatus protrusions of the adjacent apparatus movable in the spaces between protrusions so that while so moving in the spaces the anti-rotation device is not forced apart from the adjacent apparatus; and/or such devices with a less slanted protrusions face so that the tendency of one face to ride upon or be forced up on another face is reduced or eliminated.

Another embodiment of this invention provides a pair of anti-rotating devices including a first such anti-rotation device securable to a first item for use in a wellbore and a second such anti-rotation device securable to a second item for use in a wellbore each said anti-rotation device having spaced-apart device protrusions which, with the inner wall of the recess, define spaces between the protrusions into which protrusions of one device are receivable by the other device as the two anti-rotation devices approach each other to co-act, the protrusions and spaces configured and disposed so that after initial misalignment of the two devices and upon initiation of rotation of at least one of them, one protrusion of one device bears against and pivots against a recess inner wall or against a face of a protrusion of the other device to pivot one device with respect to the other to align the two devices and to bring opposing protrusion faces into planar contact.

The present invention, therefore, recognizes, addresses, meets, and satisfies the previously-describe long-felt needs.

It is therefore an object of the present invention to provide a unique, new, useful, efficient and nonobvious device for preventing the relative rotation of well apparatuses.

Another object of the present invention is the provision of a device which can be formed of or connected to a variety of well tools and apparatuses, such as, but not limited to, plugs, float collars, jars, stage cementing tools, liner hangers and clutch devices for packers to prevent their relative rotation, particularly during drill out.

A further object of the present invention is the provision of such a device or such apparatuses in which teeth or protrusions do not bear some or any of the load which may be impressed on such a device.

An additional object of the present invention is the provision of such a device or such apparatus in which teeth or protrusions on the device are spaced so that debris or foreign objects may be contained between the teeth or protrusions without hindering the interengagement of the teeth or protrusions.

Yet another object of the present invention is the provision of such a device or apparatuses with such a device in which the teeth or protrusions are configured and profiled so that their cross-section is constant from an outer edge of the device to a more central point for strength and for easy interengagement with the teeth or protrusions of another device.

A specific object of the present invention is the provision of such a device or apparatuses with such a device in which an outer edge of the teeth or protrusions is bevelled inwardly to facilitate the interengagement of two such devices.

Another object of the present invention is the provision of a non-rotation device with one or more protrusions and or one or more pockets for inhibiting or preventing movement of the device with respect to a material (e.g. concrete, cement, or plastic) in which the device is disposed.

A further object of the present invention is to provide in certain embodiments self-aligning well apparatuses and self-aligning anti-rotation devices for well apparatuses.

Another object of the present invention is to provide in certain embodiments anti-rotation devices and well apparatuses with them which have a "sloppy fit" between adjacent opposed devices.

An additional object of this invention is the provision of such devices with a space between protrusions and/or protrusions slanted in such a way that unwanted forced separation of devices is inhibited or eliminated.

Specific objects of the present invention are the provision of plugs, float collars, jars, stage tools, liner hangers and clutch devices for packers with some or all of the above-described features.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF PREFERRED EMBODIMENTS

Figure 1:
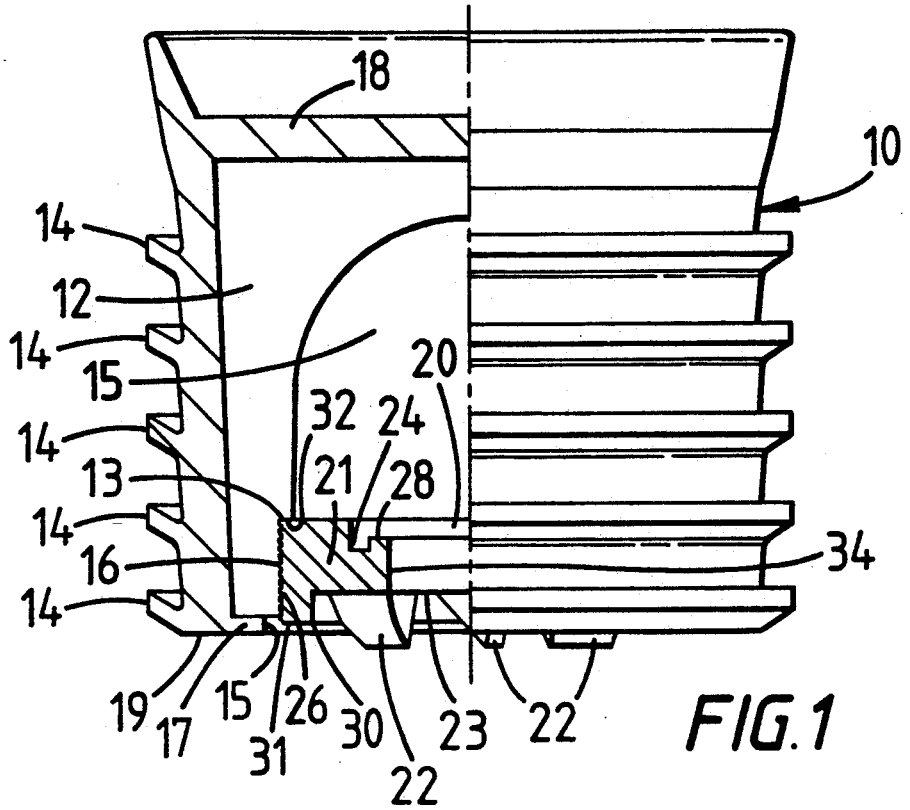
FIG. 1 is a side view, half in cross-section, of a plug according to the present invention.

Referring now to FIG. 1 a top plug 10 according to the present invention is shown which has a body 12 with a plurality of flexible wipers 14 formed integrally of and extending from the body 12. A top member 18 extends across the top of the body 12 and a bottom member 17 extends around the bottom of the body 12.

A non-rotation device 20 according to the present invention has a main member 21 with threads 26 for threadedly engaging a threaded opening 16 in the body 12 of the plug 10. An empty chamber 15 is in the center of the body 12. A plurality of teeth 22 extend from a recessed portion 23 of the main member 21 of the device 20. Herein and in the appended claims "protrusion" is meant to include a variety of shapes including bevelled, pointed, squared, rounded and non-pointed shapes whereas "teeth" is a narrower term indicating a pointed structure. A ring 30 having a face 31 extending from the main member 21 defines the periphery of the recessed portion 23 and partially extends into an opening 15 in the bottom member 17 of the plug 10. A shoulder 32 of the main member 21 abuts a face 13 of the body 12 of the plug 10. In another preferred embodiment the device 20 is disposed so that the face 31 is flush with a face 19 of the bottom member 17.

Figure 2:
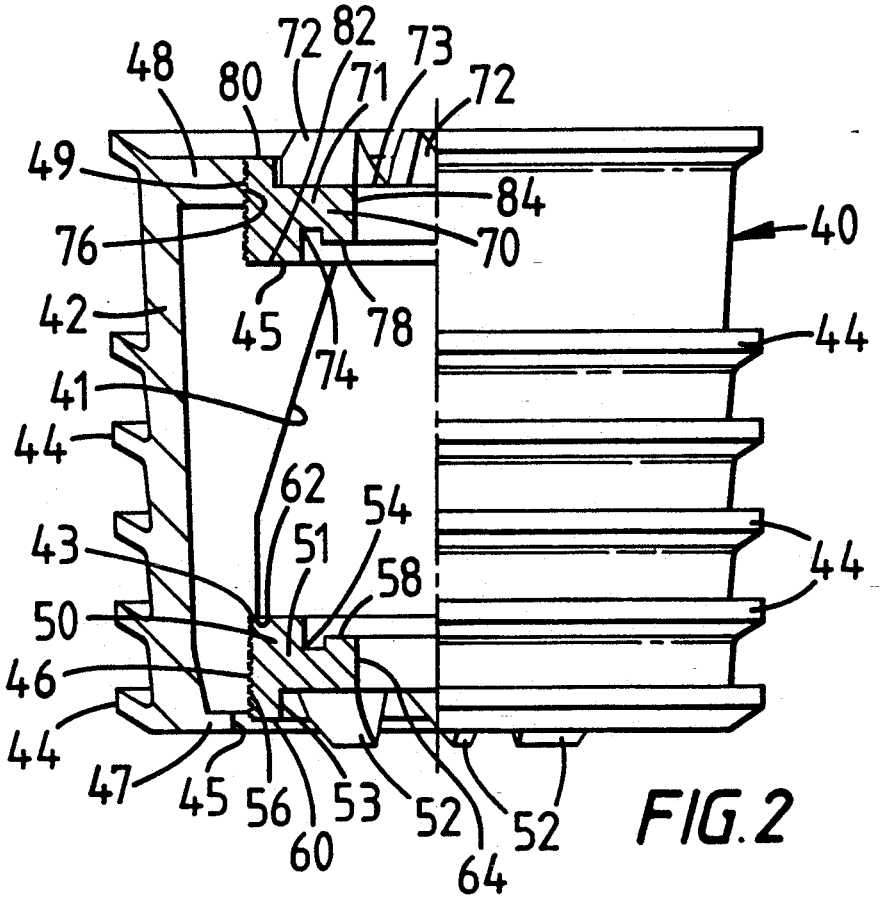
FIG. 2 is a side view, half in cross-section, of a plug according to the present invention.

Referring now to FIG. 2, a bottom plug 40 according to the present invention has a body 42 with a plurality of wipers 44 formed integrally of and extending from the body 42. A top member 48 extends around the top of the body 42 and a bottom member 47 extends around the bottom of the body 42.

A non-rotation device 50 according to the present invention (like the previously described device 20) has a main member 51 with threads 56 for threadedly engaging a threaded opening 46 in the body 42 of the plug 40. A plurality of teeth 52 extend from a recessed portion 53 of the main member 51 of the device 50. A ring 60 extending from the main member 51 defines the periphery of the recessed portion 53 and partially extends into an opening 45 in the bottom member 47 of the plug 40.

A groove 54, partially defined by a shoulder 58, in the top of the main member 51 of the device 50 is suitable for receiving and holding a portion of a diaphragm or other object for closing off a channel 64 which extends longitudinally through the device 50 and is in fluid communication with a channel 41 extending longitudinally through the plug 40. A shoulder 62 of the main member 51 abuts a face 43 of the body 42 of the plug 40.

Another non-rotation device 70 according to the present invention has main member 71 with threads 76 for threadedly engaging a threaded opening 49 in the body 42 of the plug 40. A plurality of teeth 72 extend from a recessed portion 73 of the main member 71 of the device 70. A ring 80 extending from the main member 71 defines the periphery of the recessed portion 73 and extends to the top of the top member 48 of the body 42 of the plug 40.

A groove 74, partially defined by a shoulder 78, in the bottom of the main member 71 is suitable for receiving and holding a portion of a diaphragm or other object for closing off a channel 84 which extends longitudinally through the device 70 and is in fluid communication with the channel 41 of the plug 40. A shoulder 82 of the main member 71 abuts a face 45 of the body 42 of the plug 40.

Figure 3A:
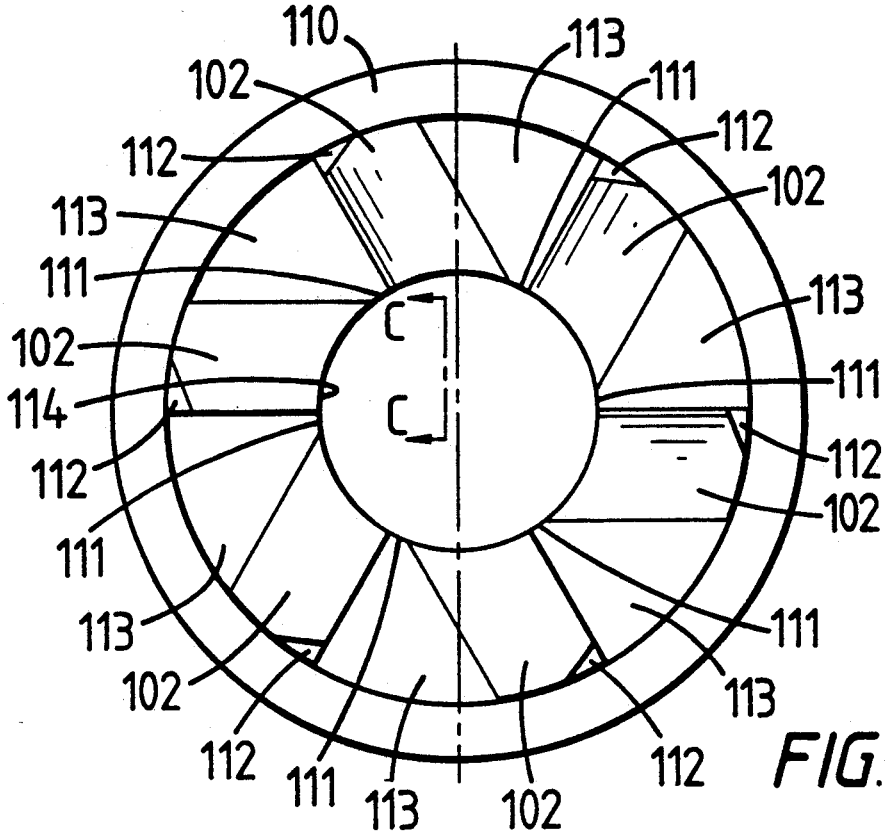
FIG. 3A is a top view of a device according to the present invention.
Figure 3B:
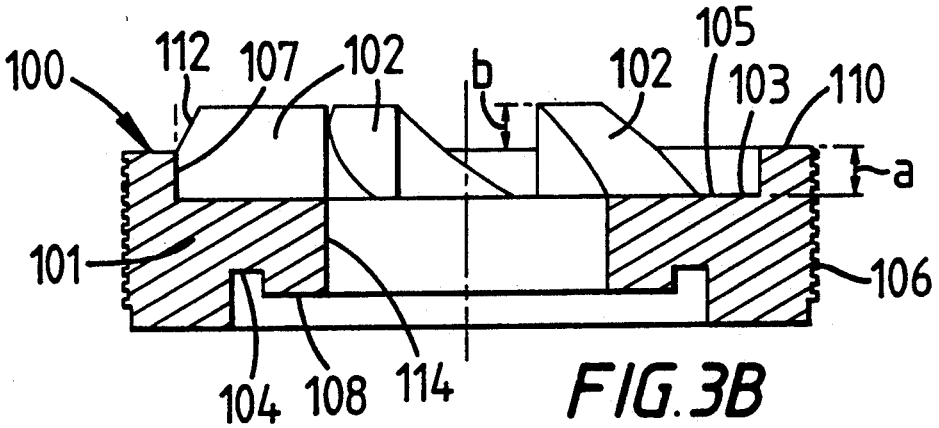
FIG. 3B is a side view in cross-section of the device of FIG. 3A.
Figure 3C:
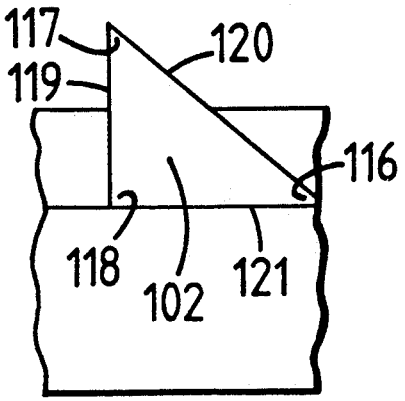
FIG. 3C is a view along line C—C of FIG. 3A.

Referring now to FIGS. 3A, 3B, and 3C, a non-rotation device 100 has a main body 101 with a threaded periphery 106 for threaded engagement with a female-threaded opening in an apparatus such as a plug or other well apparatus or tool. Of course it is within the scope of this invention to provide a device without a threaded periphery and to connect, attach, adhere, or incorporate such a non-rotation device in an apparatus or tool by any appropriate and effective method and means.

A plurality of teeth 102 extend from a recess 103 defined by a floor 105 and a side wall 107 of a ring 110 which encircles the upper portion of the main body 101. The teeth 102 extend from the side wall 107 (the outer edge of the recess 103) inwardly to the inner edge of an opening 114 (see FIG. 3A) which extends longitudinally through the plug and through which fluid flow is permitted. A circular groove 104 is disposed in the bottom of the device 100 and is configured to receive and hold a portion of a frangible diaphragm which closes off the opening 114 to fluid flow until it is broken, e.g. by the force of cement. (The "upper portion" and "bottom" of the device 100 refer to its orientation as presented in FIG. 3B—of course it may be inverted as shown in FIG. 2, device 50). The side wall 107 as shown in FIG. 3B is perpendicular to the floor 105, but it is within the scope of this invention for the wall 107 to slope from the ring 110 to the floor 105; it could mirror the angle of the teeth.

It is preferred that the distance a (FIG. 3B) from the floor 105 to the top of the ring 110 be greater than the distance b from the top of the ring to the top of the teeth so that when two of the devices such as device 100 are disposed adjacent each other with their teeth interengaged, the two rings such as rings 110 meet, contact, and bear any load on the devices while the teeth are prevented from contacting the floor of the recess of the adjacent device. In this way the rings bear a load on the devices rather than the teeth and damage due to such loading on the teeth is eliminated. In one embodiment the distance a is 0.56 inches and the distance b is 0.531 inches.

As shown in FIG. 3A, it is preferred that the teeth 102 have a constant cross-section from the inner edge of the ring 110 to the outer edge of the opening 114; i.e., their dimensions are substantially constant from the outer edge of the recess to the inner edge of the opening. Such teeth are relatively stronger as they approach the opening 114 than would be teeth whose cross-section diminishes from the outer edge of the device towards its interior. The use of a ring such as the ring 110 serves to buttress the outer edge of the teeth, protecting them and strengthening the device. Also, in some prior art devices, teeth with a diminishing cross-section are shorter the nearer they are to a device's center. It is much easier for shorter teeth to either fail to engage or to ratchet across each other.

The device 100 as shown in FIG. 3A has six teeth. It is within the scope of this invention to provide a device with one or more teeth, but it is preferred that a number of teeth be provided and spaces apart so that the space between teeth at the inner edge of an opening (such as a space 111 between the teeth 102 of device 100) and the area between teeth (such as an area 113 between the teeth 102 of the device 100) can accommodate foreign objects and debris which, if it were present on the teeth of prior art devices would inhibit or prevent proper tooth interengagement. The size of a foreign object which can be accommodated in the area 113 is determined by the size of that area. If only one tooth is used, a larger object can be accommodated; but if, e.g., ten teeth were used, the size of such an object would be smaller. Objects from above encountering a pointed tip of a tooth will move and be diverted into one of the areas 113.

Since teeth (or other protrusions) according to the present invention are partially within the device, a minor disengagement of a bouncing drill bit or of adjacent apparatuses with such devices will not result i the disengagement of the teeth of the two devices. Teeth in prior art devices that simply extend from a top surface of the device are more easily disengaged.

Referring now to FIG. 3C, the tooth 102 has a cross-sectional profile that includes a perpendicular side, side 119; a slanted side, side 120; and a base, side 121. The angles between sides are: angle 116—40°; angle 118—90°; and angle 117—30°. This profile is advantageous because the torque of drill out will be transmitted through a right angle (118) and angle 116 will give support against tooth failure. There will be only a minimal force component (or none) trying to force the teeth up or down to disengage them. Although angles 116 and 117 are shown with a preferred extent, workable preferred ranges for these angles are: angle 116, 20 to 70 degrees; angle 117, 20 to 70 degrees; angle 118, 90 to 45 degrees.

As shown in FIG. 3B, the outer edge of the teeth 102 is bevelled inwardly, see bevel 112, to facilitate the interengagement of the teeth on adjacent devices. As shown in FIG. 3B the bevel 112 is 30° from normal, but which any bevel which provides this facilitation may be used.

Figure 3D:
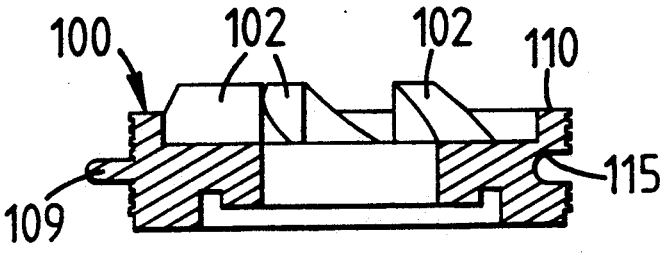
FIG. 3D is a side view of a modified version of the device of FIG. 3A.

As shown in the modified version of the device 100 in FIG. 3D, a cut-out, scoop, indentation, or recessed area 115 is provided so that when the device 100 is emplaced within a material that sets up, e.g. concrete or which hardens, e.g. a thermosetting material or plastic, some of the material enters and sets within the recess to inhibit or prevent movement of the device 100 with respect to the material. Although one recess is shown, it is within the scope of this invention to use one or more recesses; it is also within the scope of this invention to position the recess or recesses as desired on the device. The recess may be configured as desired. The recess 115 is like a pocket in the body of the device 100, but it is within the scope of this invention to employ recesses of different shapes, including but not limited to an elongated recess or a groove partially or entirely encircling the device 100. A projection 109 extending from the device 100 is also used to inhibit or prevent movement of the device 100 with respect to materials as already described. One or more projections may be employed and it or they may be disposed as desired on the device 100 within the scope of this invention; also although the projection 109 is shown as finger-like, any desirable configuration may be used.

Figure 4A:
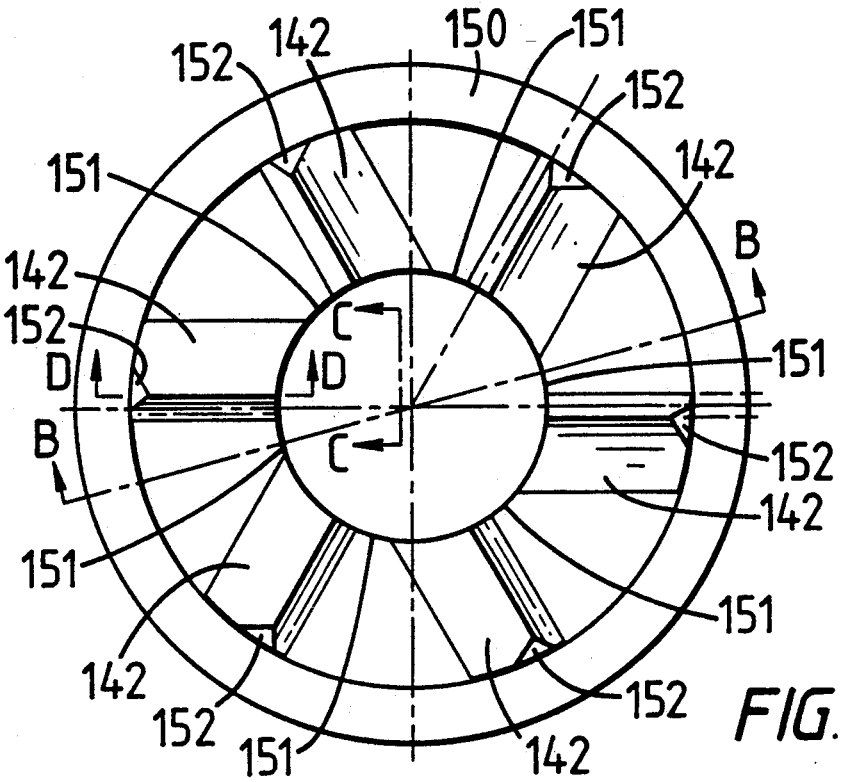
FIG. 4A is a top view of a device according to the present invention.
Figure 4B:
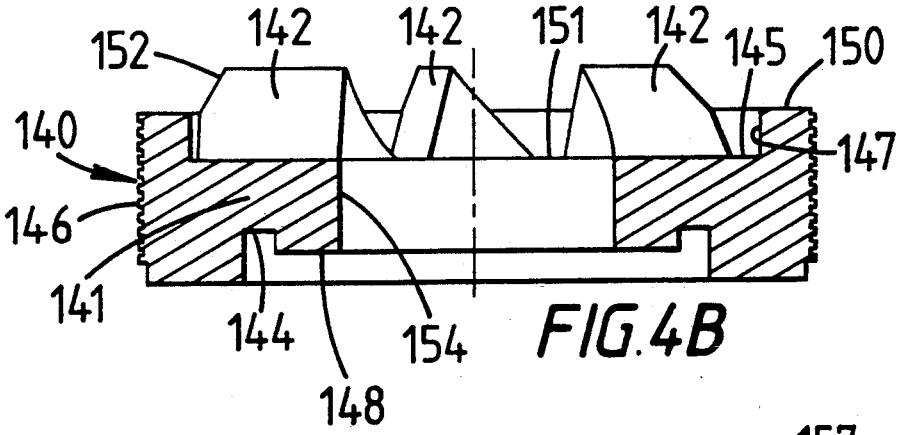
FIG. 4B is a view along line B—B of FIG. 4A.
Figure 4D:
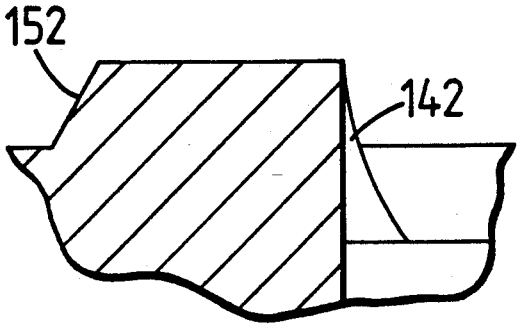
FIG. 4D is a view along line D—D of FIG. 4A.
Figure 4C:
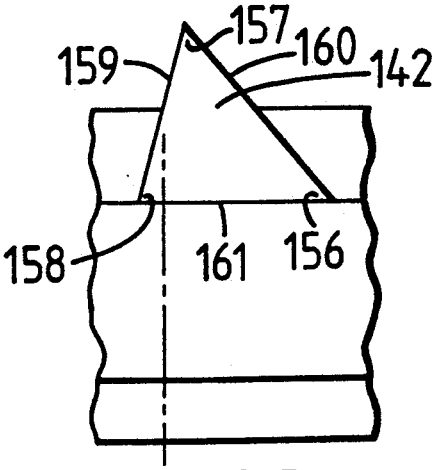
FIG. 4C is a view along line C—C of FIG. 4A.

A non-rotation device 140 as shown in FIGS. 4A, 4B, and 4C is very similar in structure and operation to the device 100 previously described; but the device 140 has a plurality of teeth 142 with a slightly different cross-sectional profile. As shown in FIG. 4C, a tooth 142 with sides 159, 160, and 161, as viewed from the end, forms a triangle with angles of 50° (angle 156); 75° (angle 158); and 55° (angle 157). A tooth with this profile has strength for engagement and when torque is applied. Although angles 156, 157, and 158 are shown with a preferred extent, workable preferred ranges for these angles are as follows; angle 156, 20 to 70 degrees; angle 157, 20 to 70 degrees; and angle 158, 90 to 45 degrees.

The non-rotation device 140 has a main body 141 with a threaded periphery 146 for threaded engagement with a female-threaded opening in another apparatus. A plurality of teeth 142 extend from a recess 143 defined by a floor 145 and a side wall 147 of a ring 150 which encircles the upper portion of the main body 141. The teeth extend radially from the side wall 147 (see FIG. 4A) inwardly to the edge of an opening 154 which extends longitudinally through the device and through which fluid flow is permitted. A circular groove 144 is disposed in the bottom of the device 140 and is configured to receive and hold a portion of a frangible diaphragm which closes off the opening 154 to fluid flow until it is broken.

Figure 5:
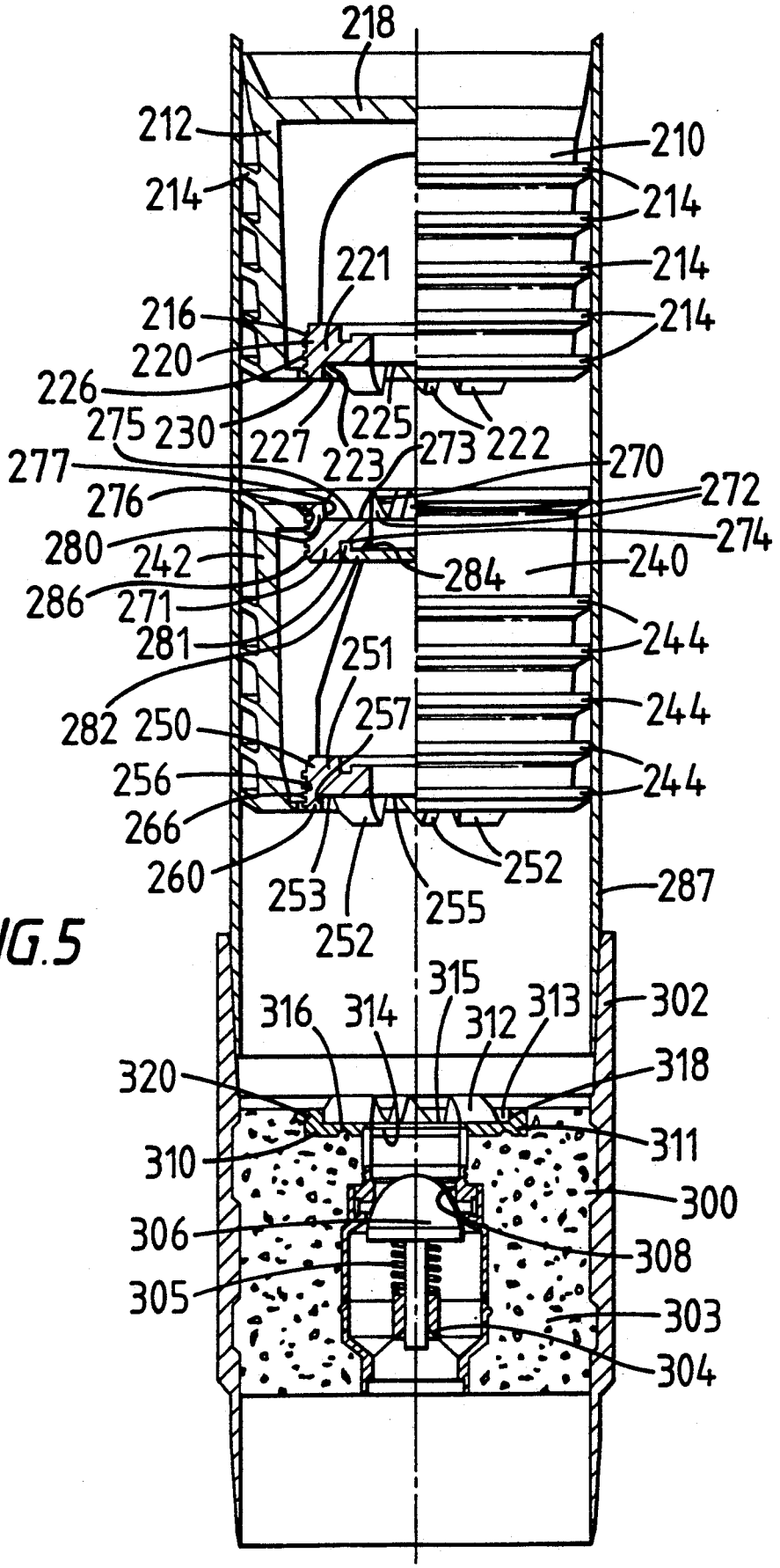
FIG. 5 is a side view partially in cross-section of a top plug, bottom plug, and float shoe according to the present invention.

Referring now to FIG. 5, a plug set and float shoe are shown according to the present invention. A top plug 210 is disposed above, but not yet in contact with, a bottom plug 240. The bottom plug 240 is disposed above, but not yet in contact with, a float shoe 300.

The top plug 210 is similar to the plug 10, previously described. The plug 210 has a body 212 with a plurality of wipers 214 extending therefrom. A non-rotation device 220 (like the non-rotation device 20) is threadedly engaged in an opening 216 in the bottom of the body 212 by threads 226 on the periphery of a main member 221 of the device 220. A plurality of teeth 222 extend from a recess 223 defined by a floor 225 and a side wall 227 of a ring 230 which encircles the top of the main member 221. The teeth 222 are like the teeth 22 and 142 previously described.

The bottom plug 240 is like the plug 40, previously described. The plug 240 has a body 242 with a plurality of wipers 244 extending therefrom. A non-rotation device 250 (like the non-rotation device 50) is threadedly engaged in an opening 246 in the bottom of the body 242 by threads 256 on the periphery of a main member 251 of the device 250. A plurality of teeth 252 extend from a recess 253 defined by a floor 255 and a side wall 257 of a ring 260 which encircles the bottom of the main member 251. The teeth 252 are like the teeth 52 and 142 previously described.

The plug 240 has a non-rotation device 270 (similar to the non-rotation device 70) which is threadedly engaged in an opening 276 in the top of the body 242 by threads 286 on the periphery of a main member 271 of the device 270. A plurality of teeth 272 extend from a recess 273 defined by a floor 275 and a side wall 277 of a ring 280 which encircles the top of the main member 271. The teeth 272 are like the teeth 72 and 142 previously described.

A circular groove 274 is disposed in the bottom of the main member 271. An upstanding shoulder 281 of a frangible diaphragm 282 is held in the groove 274 to maintain the diaphragm 282 in place over an opening 284 that extends longitudinally through the device 270. Fluid flow is permitted through the opening 284 when it is not closed off by the diaphragm 282.

The float shoe 300 has an outer tubular body 302 which is threadedly connected to a casing joint 287. An amount of hardened cement 303 surrounds a check valve 304 mounted substantially in the center of the float shoe 300. A non-rotation device 310 as shown is mounted on the check valve 304 in the cement 303, but it could be mounted so as not to contact the check valve.

The non-rotation device 310 has a main member 311 and a plurality of teeth 312 which extend upwardly from a recess 313 defined by a floor 315 and a side wall 317 of a ring 320 which extends around the top of the main member 311. The teeth 312 are like the teeth 72 and 142 previously described. An opening 314 extends longitudinally through the device 310 and permits fluid flow therethrough.

The check valve 304 itself is a typical prior art valve having a main body 310 with a plunger 306 that is urged upwardly by a spring 305 to close off flow through the valve by closing off a channel 308 in and through the valve body.

The opening 308 is in fluid communication with the opening 314 in the device 310, which itself is in fluid communication with the interior of the casing joint 287.

Pockets 316 and 318 in the main member 311 of the device 310 have cement 303 in them. The cement inhibits movement of the device 310 with respect to the cement 303, particularly during drill out.

Figure 6A:
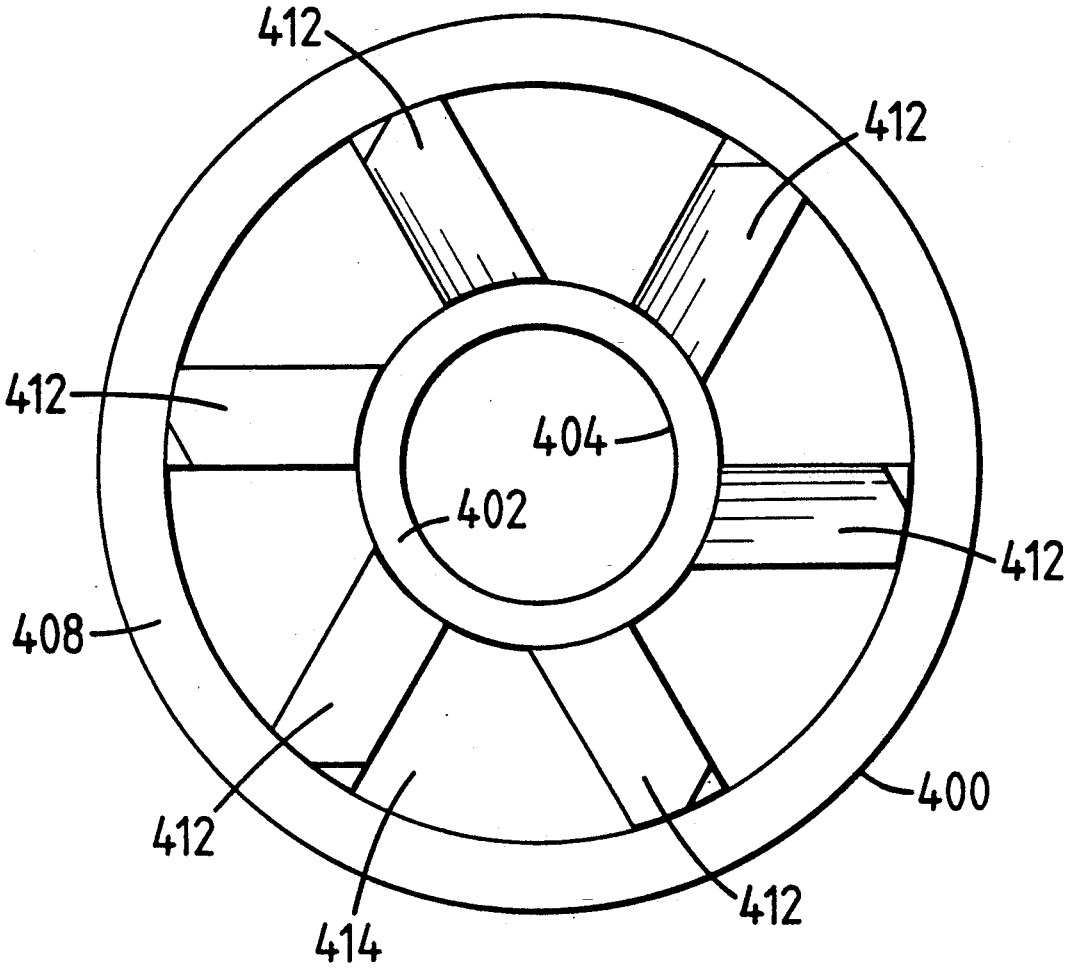
FIG. 6*a* is a top view of an anti-rotation device according to the present invention.
Figure 6B:
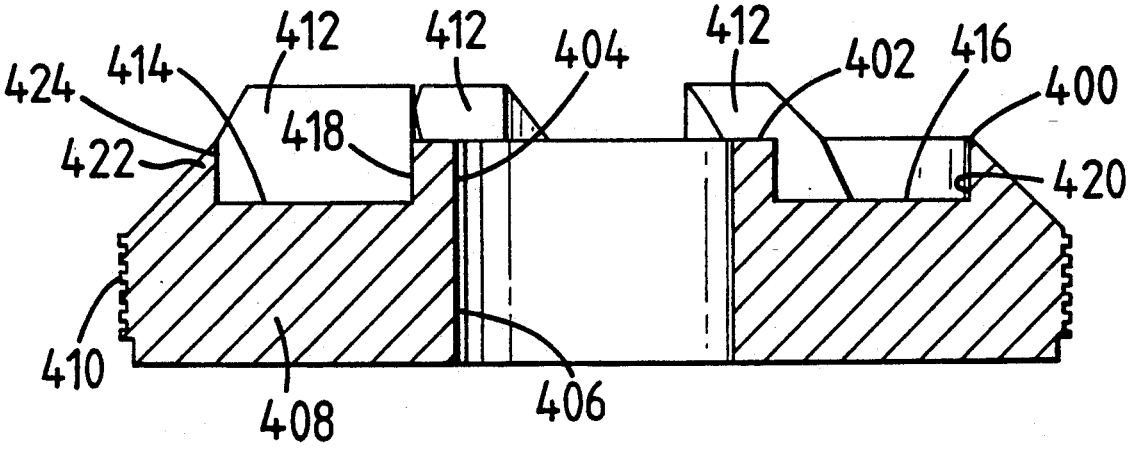
FIG. 6*b* is a side view in cross-section of the device of FIG. 6*a*.

A non rotation device 400 as shown in FIGS. 6*a* and 6*b* is similar to devices 100 and 140, previously described; but it has a load bearing ring 402 located centrally of the device around an opening 404 of a flow channel 406 through the device. The device 400 has a main body 408 with a threaded periphery 410 for threaded engagement with a female-threaded opening in another apparatus. A plurality of teeth 412 extend from a recess 414 defined by a floor 416, a side wall 418 of the ring 402 which encircles the opening 404, and a side wall 420 of a lip 422 extending around the device's outer periphery. The teeth 412 extend radially from the side wall 420 inwardly to the edge of the ring 402. The tip 424 of the lip 422 is tapered to a point. By using a reverse taper on an adjacent apparatus (e.g. a plug) better centering of two adjacent devices or apparatuses is achievable and a better seal may be obtained between the two.

Although the load members (rings) shown in these preferred embodiments are circular and continuous, it should be understood that it is within the scope of this invention to provide discrete upstanding members (one or more) which extend sufficiently upward from the recess of the device to take some or all of the load off of the teeth when two devices meet.

Figure 7A:
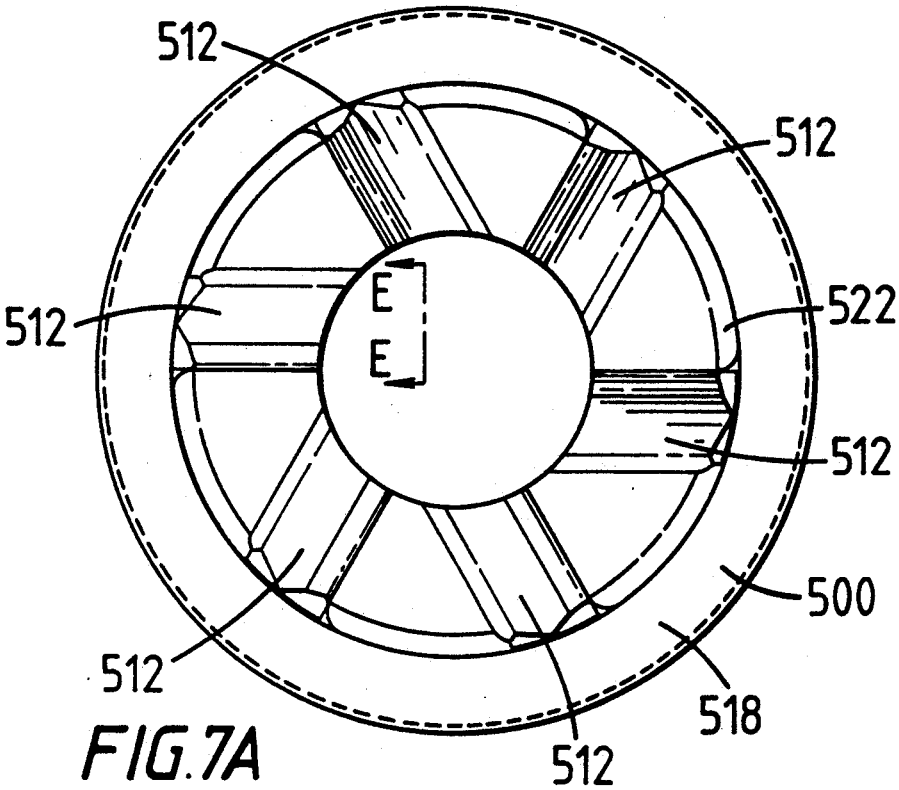
FIG. 7*a* is a top view of a device according to the present invention.
Figure 7B:
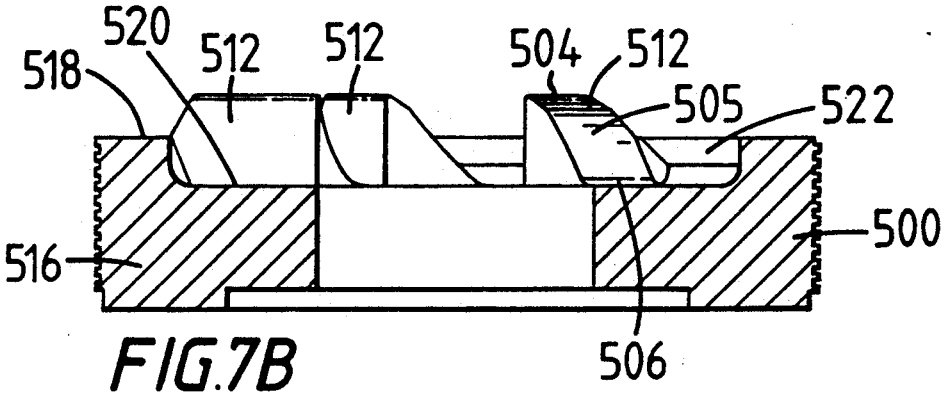
FIG. 7*b* is a side view in cross-section of the device of FIG. 7*a*.
Figure 7C:
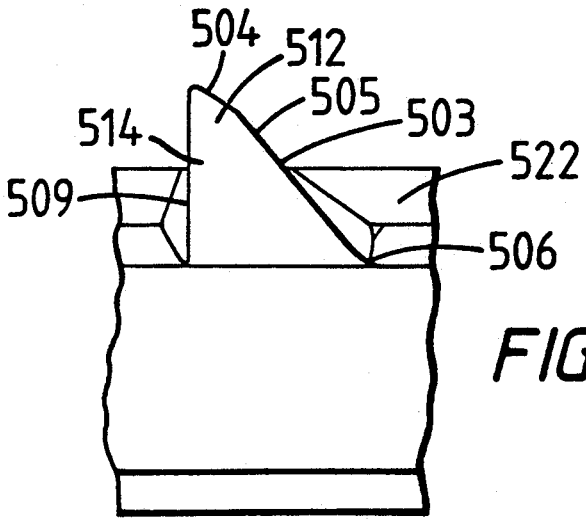
FIG. 7*c* is a view along line E—E of FIG. 7*a*.
Figure 8:
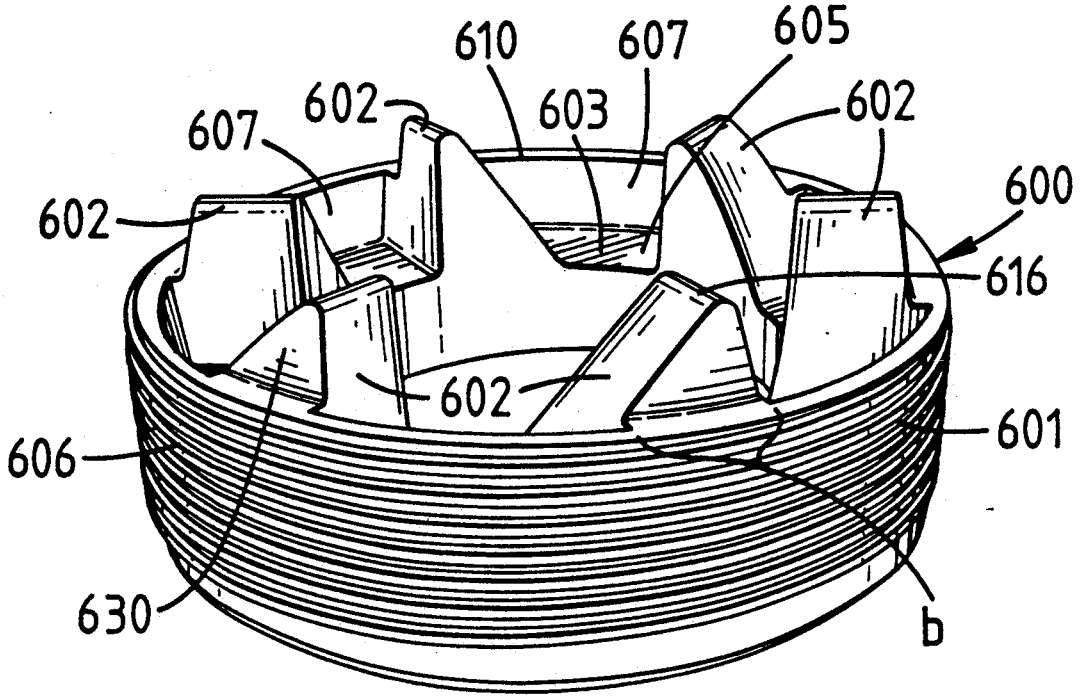
FIGS. 8–14 are view of other embodiments of the invention.

As shown in FIGS. 7*a*, 7*b*, and 7*c*, teeth for an anti-rotation device according to the present invention may have a surface comprising a plurality of subsurfaces and an inwardly tapering lip may be provided around a device's recess to facilitate engagement and sealing. Teeth 512 (shown to scale) of an anti-rotational device 500 according to the present invention have a body member 514 defined by a substantially straight side surface 509 and a surface 503 comprised of sub-parts 504, 505 and 506. The anti-rotation device 500 a main body member 516, a load bearing ring 518, and a recess 520. This device is similar to those previously described herein. It has an inwardly tapering lip 522 extending around the outer periphery of the recess 520.

Figure 10:
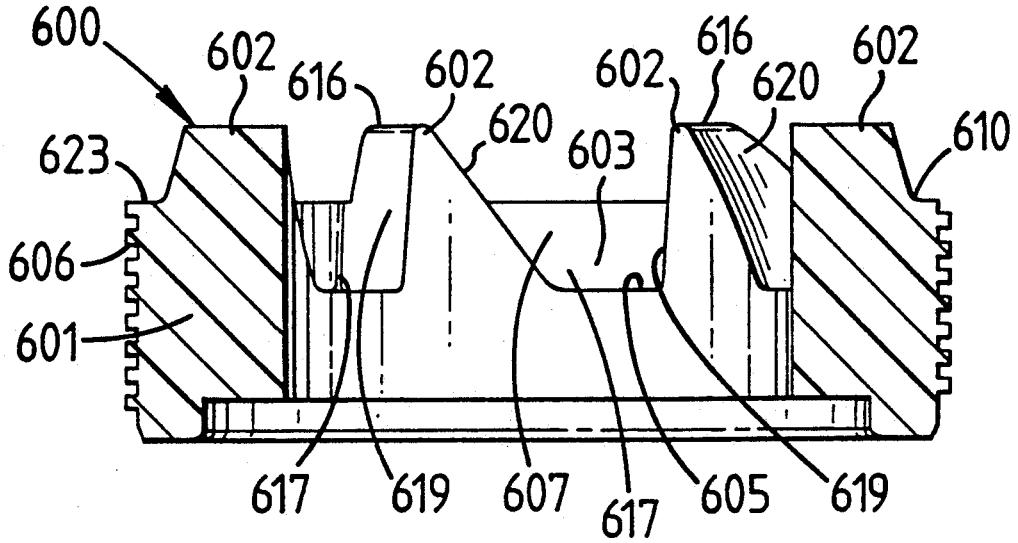
Figure 11:
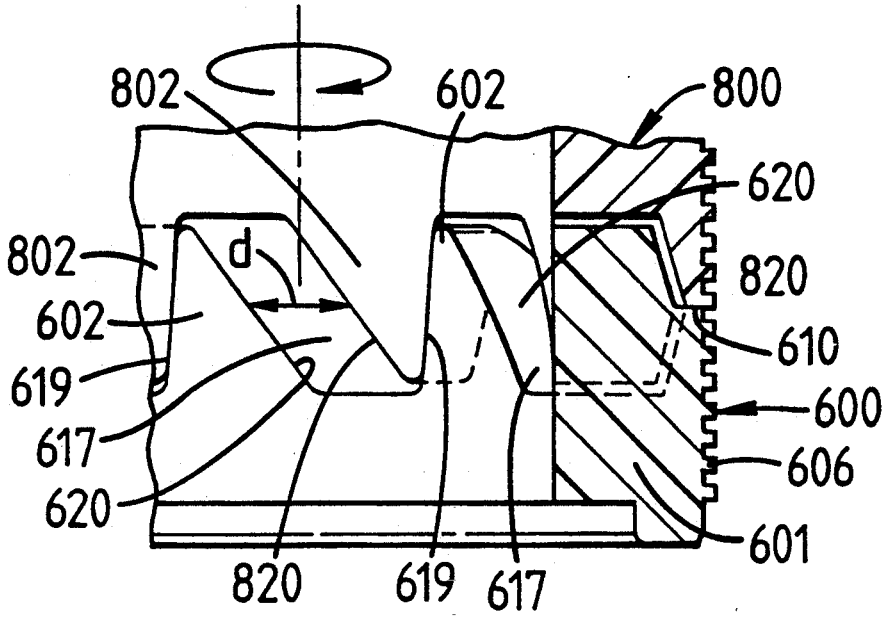
Figure 12:
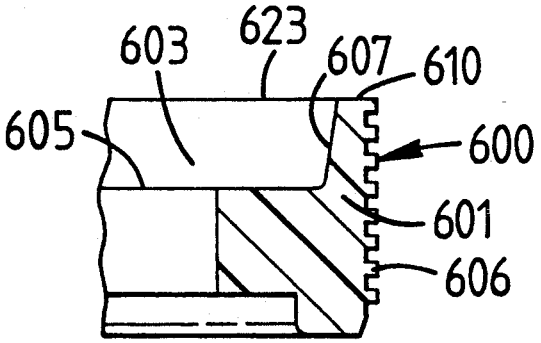
Figure 13:
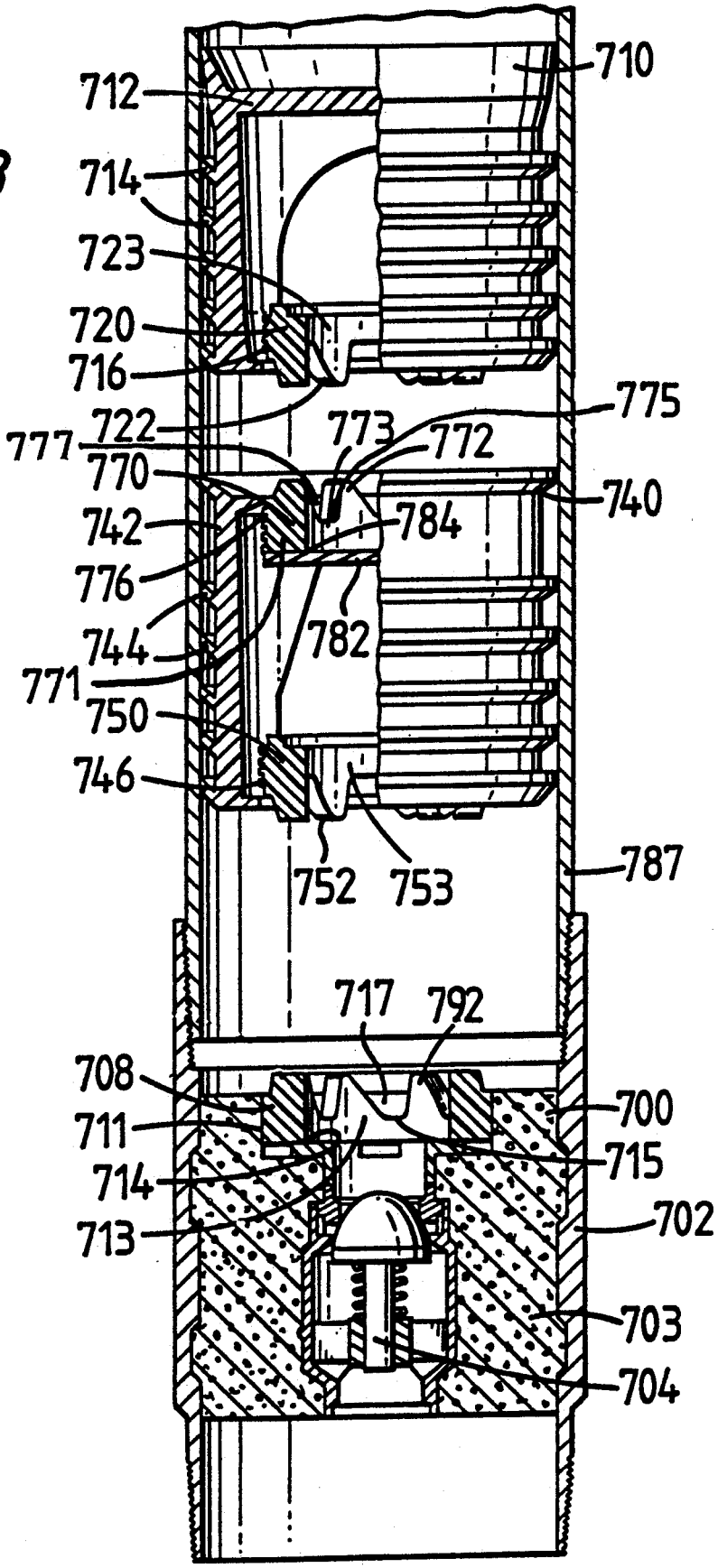

Referring now to FIGS. 8–12, a self-aligning non-rotation device 600 has a main body 601 with a threaded periphery 606 for threaded engagement with a female threaded opening of an apparatus such as a plug, float collar, or other well apparatus or tool. A plurality of protrusions 602 extend from a recess 603 defined by a floor 605 and a side wall 607 of a ring 610 which encircles the upper portion of the main body 601. By plurality is meant two or more such protrusions, with three to seven preferred. The protrusions 602 extend inwardly to the inner edge of an inner channel or opening 614 which extends longitudinally through the plug and through which fluid flow is permitted. (In certain devices no opening 614 is needed); A circular groove (not shown but like groove 104 FIG. 3B) may be disposed in the bottom of the device to receive and hold a portion of a frangible diaphragm which closes off the opening 614 to fluid flow until it is broken, e.g. by the force of cement. (The "upper portion" and "bottom" of the device 600 refer to its orientation as presented in FIG. 8—of course such a device may be inverted as shown in FIG. 13). The side wall 607 as shown in FIG. 12 preferably slopes to the floor 605, but it is within the scope of this invention for the wall 607 to be normal to the floor 605. Numeral 630 indicates an outer side of a device protrusion 602.

It is preferred that the distance from the floor 605 to the top of the ring 610 be greater than the distance from the top of the ring to the top of the protrusions so that when two devices, e.g. but not limited to devices such as device 600, are disposed adjacent each other with their protrusions in contact, either their body portions meet and the two rings are held apart, or the two rings (such as rings 610) meet, contact and bear a load on the devices while the protrusions are prevented from contacting an adjacent member, (e.g. but not limited to prevented from contacting the floor of the recess of the adjacent device). In this way the rings, rather than the protrusions, bear a load on the devices and damage due to such loading on the protrusions is reduced or preferably eliminated. This is shown in FIGS. 11 and 14 with the devices 600 and the devices 800 with its protrusions 802 (like the protrusions 602) which have a less slanted side 819 and a more slanted side 820.

Figure 9:
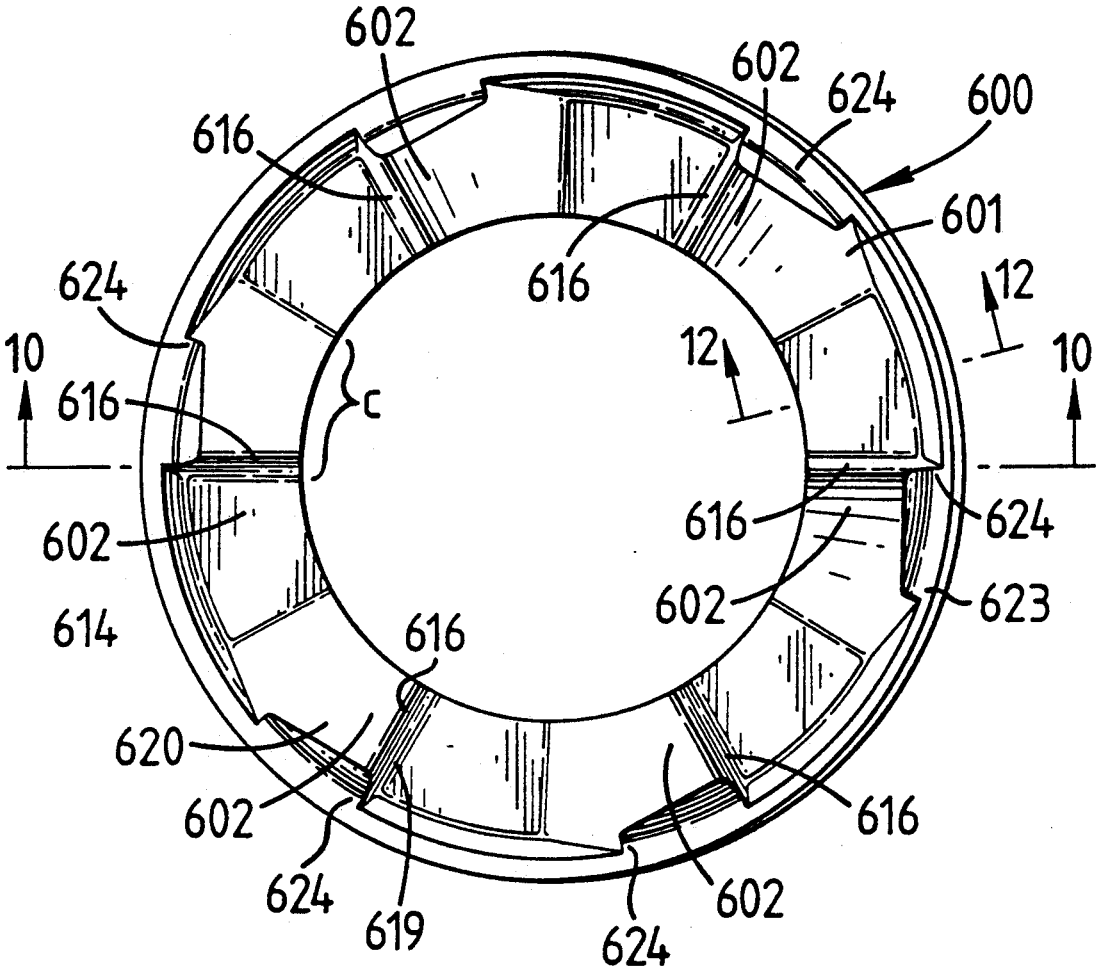

As shown in FIG. 9, it is preferred that the protrusions 602 have a cross-section that varies from the inner edge of opening 614 to near the outer edge of the opening 600; i.e., their dimensions change from the outer edge to the inner edge of the opening such that a top rounded surface 616 of each protrusion is wider at the outer edge of the device than at the inner edge.

A space 617 between protrusions can accommodate foreign objects and debris. This space also permits protrusions of one device to move within the recess for a short distance without forcing the two devices apart (e.g. the forced separation and consequent undesirable disengagement that can occur with geometrically matching tooth engagement as mentioned in U.S. Pat. No. 4,858,687). For example a device 800 (FIG. 11) can move a distance "d" horizontally before the more slanted sides 820 of protrusions 802 meet sides 620 of protrusions 602 forcing the devices apart as they rotate with respect to each other (e.g. slanted from normal with respect to the recess floor). Such action with prior art devices (e.g. devices as in U.S. Pat. No. 4,858,687) can result in unwanted device separation.

Figure 14:
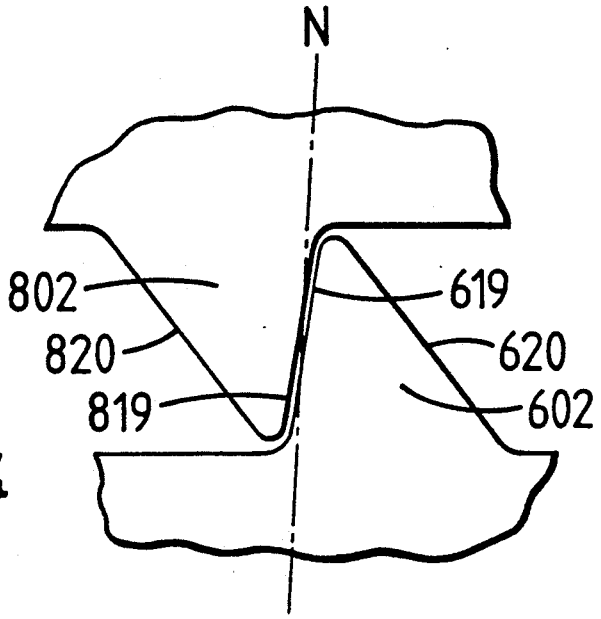

Referring now to FIGS. 10, 11 and 14 in particular, it is seen that the protrusions have a cross-sectional profile that includes a side or face surface 619, preferably slightly sloped from normal and a more slanted side or face surface 620. It is preferred that the sides 619 be slanted between about 89 to about 45 degrees with respect to a line normal (see, e.g., line N, FIG. 14) to the recess floor 605, with about 85 degrees most preferred. In embodiments in which the sides 619 are more slanted (e.g. substantially more slanted than 45 degrees from normal) there is a reduced tendency for a side 619 to ride up on or to be forced up on an adjacent protrusion's side causing unwanted device separation. It is preferred that the sides 620 be slanted between about 30 to about 60 degrees with respect to a line normal to the recess floor 605, with about 45 degrees most preferred. This profile with two planar sides 619 and 620 when used on protrusions of two opposed devices is advantageous because it provides for planar contact and it reduces or eliminates the possibility of point contact or line contact between protrusions and/or between protrusions and other portions of devices. Compressive forces are dissipated with planar contact and rotative forces are more efficiently transmitted with planar contact.

As shown clearly in FIG. 12 the side wall 607 slopes down to the floor 605. Such a wall is thicker at its base than at the top and is, therefore, stronger than a wall would be that is as thin at the top (as shown in FIG. 12) as at its bottom. The thickened sloped area of the wall 607, in addition to strengthening the wall and the device 600, also facilitates contact of two devices such as the device 600. Contact is also facilitated by inwardly sloped protrusion surfaces 620 and by recessing device protrusions from a rim top 623 which extends from the outer edge of the device 600 inwardly to the protrusions 602. Protrusions engage the recess wall and are thereby directed properly into contact with adjacent protrusions. At the location of each protrusion 602 adjacent the rim top 623 is an indented portion 624 of the rim top 623 which provides for a relatively "sloppy" fit of two devices (like device 600) as the device protrusions are contacting, thereby facilitating their self-alignment contact and co-action. Viewed in another way, the protrusions are offset from the rim top so they do not fit tightly into an opening or recess in an adjacent apparatus to facilitate device contact and co-action.

It is preferred that there be spaces between the protrusions, e.g. between the protrusions 602, rather than having a plurality of protrusions immediately adjacent each other (The teeth of the devices in U.S. Pat. No. 4,858,687 have no such spaces between teeth and a relatively large plurality of relatively small teeth are required since the teeth bear a load.) Since the protrusions of devices according to certain preferred embodiments of this invention do not bear a load, they can be configured and spaced apart for optimum ease of alignment, contact and co-action and so that damage to protrusions is minimized. For the embodiment shown in FIG. 8 it is most preferred that for a device whose overall diameter is about 5 inches and whose inner channel has a diameter of about 3¼ inches, there be six protrusions, each about 1 1/16 inches high, with a space between protrusions of about ¾ inch. It is preferred that the bases "b" of the protrusions occupy about 30% to about 70% of a device's circumference, and that the bases "c" occupy abut 30% to about 70% of the diameter of an inside channel through a device with about 50% most preferred. In the preferred embodiments (in which one face of a protrusion is more slanted), if opposed protrusions' more slanted faces contact initially, the slanted faces will move on each other and the devices will rotate to bring the two less slanted faces into alignment and contact so that the two less slanted faces can then co-act to inhibit relative rotation between adjacent devices.

Referring now to FIG. 13, a plug set and float collar are shown according to the present invention. A top plug 710 is disposed above, but not yet in contact with, a bottom plug 740. The bottom plug 740 is disposed above, but not yet in contact with a float shoe 700. The float collar 700 is like the float equipment in FIG. 5.

The top plug 710 has a body 712 with a plurality of wipers 714 extending therefrom. A portion of a non-rotation device 720 (like the non-rotation device 600, FIG. 8) threadedly engages threads around an opening 716 in the bottom of the body 712. A plurality of protrusions 722 extend from a recess 723 defined like the recess 603, FIG. 8.

The bottom plug 740 has a body 742 with a plurality of wipers 744 extending therefrom. A portion of a non-rotation device 750 (like the non-rotation device 600, FIG. 8) threadedly engages threads around an opening 746 in the bottom of the body 742. A plurality of protrusions 752 extend from a recess 753 like the recess 603, FIG. 8.

The plug 740 has a non-rotation device 770 (similar to the non-rotation device 600) a portion of which threadedly engages threads around an opening 776 in the top of the body 742. A plurality of protrusions 772 extend from a recess 773 defined by a floor 775 and a side wall 777 of a ring 780 which encircles the top of a main member 771.

A frangible diaphragm 782 is mounted over an opening 784 that extends longitudinally through the device 770. Fluid flow is permitted through the opening 784 when it is not closed off by the diaphragm 782, thus permitting fluid flow through the plug 740 through its hollow center.

The float collar 700 has an outer tubular body 702 which is threadedly connected to a casing joint 787. An amount of hardened cement 703 surrounds a check valve 704 mounted substantially in the center of the float collar 700. A non-rotation device 708 as shown is mounted on the check valve 704, but it could be mounted so as not to contact the check valve.

The non-rotation device 710 (like the device 600, FIG. 8) has a main member 711 and a plurality of protrusions 792 which extend upwardly from a recess 713 defined by a floor 715 and an inner side wall 717 which extends around the top of the main member 711. An opening 714 extends longitudinally through the device 710 and permits fluid flow therethrough.

The check valve 704 itself is a typical prior art valve, like the valve 304, FIG. 5.

A significant portion of each non-rotation device 720, 750, 770, and 708 extends beyond the members to which the devices are connected (preferably removably secured e.g. with adhesives, key-slot arrangements, or threadedly). The extending portion includes portions of protrusions which can contact each other before contact between other parts of the members to which the devices are connected. Thus, it is possible for protrusions on adjacent members to contact and move into co-acting position before their respective load bearing members touch. Such an arrangement of protrusions (with protrusions configured as previously described) permits the devices to accommodate initial protrusion misalignment and reduces or eliminates the tendency of protrusions to damage each other or to ratchet past each other (as can occur with prior art devices, e.g. those mentioned in U.S. Pat. No. 4,858,687).

Upon initial contact and co-action two plugs (or other items) with anti-rotation devices according to this invention may be axially misaligned. Upon the initiation of rotation (of at least one device) one of the protrusions of one plug's device will pivot against a protrusion or against the recess side wall of the other plug's device to align the devices (and hence the plugs); or conversely one side wall of one device's recess will pivot against a side of a protrusion of the opposing device or a protrusion making line contact with a protrusion of the other device will pivot against the protrusion to align the devices. For example the outer side 630 of a device protrusion 602 will pivot against a recess side wall of an adjacent device (like wall 607, see FIG. 12) to align two opposing devices in items used on wellbores (e.g. plugs, plug and float equipment, etc.) or a protrusion 602 will make line contact with a protrusion 802 upon initial misalignment of the devices 600 and 800 (FIG. 11) and then upon the initiation of rotation the faces of the protrusions will come into planar contact and also the design will align.

In conclusion, therefore, it is seen that the present invention and the embodiments disclosed herein are well adapted to carry out the objectives and obtain the ends set forth at the outset. Certain changes can be made in the method of apparatus without departing from the spirit and the scope of this invention. It is realized that changes are possible and it is further intended that each element recited in any of the following claims is to be understood as referring to all equivalent elements for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as other inherent therein.

What is claimed is:

1. An anti-rotation device for an item used in wellbores for inhibiting relative rotation between the item and an adjacent apparatus having apparatus protrusions, each apparatus protrusion having two planar faces, the anti-rotation device comprising a substantially cylindrical body member having two ends, an inner wall, and a rim extending around one of the ends, and plurality of device protrusions extending from the body member and beyond the rim, each device protrusion having a rounded top, each of the device protrusions disposed for contacting one of the apparatus protrusions of the adjacent apparatus, the device protrusions offset from the rim inwardly toward a center of the body member to facilitate contacting of and co-action with the item used in wellbores and the adjacent apparatus, an upwardly extending portion of each device protrusion having two planar faces to reduce point and line contact between the device protrusions and the adjacent apparatus, the rounded top portion of each device protrusion wider at an outer edge of the body member than at an inner part thereof, and a recess in the body member, the recess defined by the inner wall and a bottom surface within the body member, the device protrusions extending from the bottom surface of the recess and disposed for contacting and co-acting with the apparatus protrusions of the adjacent apparatus, the inner wall sloping to the bottom surface of the recess, and the faces of the protrusions disposed so that only one face of each device protrusion co-acts with only one face of each apparatus protrusion while inhibiting relative rotation between the anti-rotation device and the item used in wellbores.

2. The anti-rotation device of claim 1 including also a plug having a top and a bottom and the anti-rotation device secured to the plug.

3. An anti-rotation device for an item used in wellbores for inhibiting relative rotation between the item and an adjacent apparatus having apparatus protrusions, the anti-rotation device comprising a substantially cylindrical body member having two ends and a rim extending around one of the ends, and a plurality of device protrusions extending from the body member and beyond the rim, the device protrusions disposed for contacting the apparatus protrusions of the adjacent apparatus, a top portion of each device protrusion rounded and wider at an outer edge of the body member than at an inner part thereof, the device protrusions and the apparatus protrusions each having at least two faces, the faces of the protrusions configured and disposed so that upon contact of the apparatus protrusions and device protrusions each device protrusion contacts one corresponding apparatus protrusion and upon co-action of said device protrusions with said apparatus protrusions only one face of each said device protrusion co-acts with only one face of each said apparatus protrusion while inhibiting relative rotation between the item and the adjacent apparatus.

4. The anti-rotation device of claim 3 wherein each face of the device protrusions is a planar face to facilitate planar contact of the item used in wellbores and the adjacent apparatus and to reduce point and line contact between the device protrusions and the adjacent apparatus.

5. An anti-rotation device for an item used in wellbores for inhibiting relative rotation between the item and an adjacent apparatus having apparatus protrusions, the anti-rotation device comprising a substantially cylindrical body member having an inner wall, two ends and a rim extending around one of the ends, and a plurality of device protrusions extending from the body member and beyond the rim, the device protrusions disposed for contacting the apparatus protrusions of the adjacent apparatus, the device protrusions and the apparatus protrusions each having at least two faces, the faces of the protrusions configured and disposed so that upon contact of the apparatus protrusions and device protrusions each device protrusion contacts one corresponding apparatus protrusion and upon co-action of said device protrusions with said apparatus protrusions only one face of each said device protrusion co-acts with only one face of each said apparatus protrusion while inhibiting relative rotation between the item and the adjacent apparatus, and a recess in the body member, the recess defined by the inner wall and a bottom surface within the body member, the device protrusions extending from the bottom surface of the recess and disposed for contacting and co-acting with the apparatus protrusions of the adjacent apparatus.

6. The anti-rotation device of claim 5 wherein the inner wall slopes to the bottom surface of the recess.

7. An anti-rotation device for an item used in wellbores for inhibiting relative rotation between the item and an adjacent apparatus having apparatus protrusions, the anti-rotation device having a circumference and comprising a substantially cylindrical body member having an inner wall, two ends and a rim extending around one of the ends, and a plurality of device protrusions extending from the body member and beyond the rim, the device protrusions disposed for contacting the apparatus protrusions of the adjacent apparatus, the device protrusions offset from the rim inwardly toward a center of the body member to facilitate contact of and co-action with the item used in wellbores and the adjacent apparatus, a recess in the body member, the recess defined by the inner wall and a bottom surface within the body member, the device protrusions extending from the bottom surface of the recess and disposed for contacting and co-acting with the apparatus protrusions of the adjacent apparatus, the device protrusions spaced apart from each other about the circumference of the anti-rotation device, each device protrusion having a base at the floor of the recess, the bases occupying between about 30% to about 70% of the device's circumference with spaces between the protrusions, apparatus protrusions of the adjacent apparatus movable in the spaces between device protrusions so that while so moving in the spaces the anti-rotation device is not forced apart from the adjacent apparatus.

8. The anti-rotation device of claim 7 wherein the bases occupy about 50% of the circumference.

9. The anti-rotation device of claim 7 comprising also a plug having a top and a bottom and the anti-rotation device secured to the plug.

10. A pair of anti-rotating devices of claim 7, including a first such anti-rotation device securable to a first item for use in a wellbore and a second such anti-rotation device securable to a second item for use in a wellbore each said anti-rotation device having spaced-apart device protrusions which, with the inner wall of the recess, define spaces between the protrusions into which protrusions of one device are receivable by the other device as the two anti-rotation devices approach each other to co-act, the protrusions and spaces configured and disposed so that after initial misalignment of the two devices and upon initiation of rotation of at least one of them one protrusion of one device bears against and pivots against a recess inner wall or protrusion of the other device to pivot one device with respect to the other to align the two devices.

11. The pair of anti-rotation devices of claim 10 comprising also two items for use in a wellbore including a first item and a second item, the first anti-rotation device secured to the first item and the second anti-rotation device secured to the second item.

12. The pair of anti-rotation devices of claim 11 wherein the two items are plugs.

13. The pair of anti-rotation devices of claim 11 wherein the first item is a plug and the second item is a piece of float equipment.

* * * * *